US010898032B1

(12) United States Patent
Wells

(10) Patent No.: US 10,898,032 B1
(45) Date of Patent: Jan. 26, 2021

(54) PORTABLE MULTI-COMPONENT FLUID AND PAPER BASED PRODUCT DISPENSER

(71) Applicant: Channing Wells, Raymond, MS (US)

(72) Inventor: Channing Wells, Raymond, MS (US)

( * ) Notice: Subject to any disclaimer, the term of this patent is extended or adjusted under 35 U.S.C. 154(b) by 0 days.

(21) Appl. No.: 16/946,335

(22) Filed: Jun. 17, 2020

Related U.S. Application Data

(60) Provisional application No. 62/704,614, filed on May 18, 2020.

(51) Int. Cl.
*A47K 5/12* (2006.01)
*A47K 10/42* (2006.01)

(52) U.S. Cl.
CPC ..... *A47K 5/1205* (2013.01); *A47K 10/424* (2013.01)

(58) Field of Classification Search
CPC ..... A47K 5/1205; B05B 11/0054; B05B 11/0078; B65D 51/1611; B65D 81/245; B65D 83/08; B65D 83/75; B65D 2583/082
See application file for complete search history.

(56) References Cited

U.S. PATENT DOCUMENTS 4,436,224 A * 3/1984 McInerny ..... A47K 10/32 221/96
4,809,878 A * 3/1989 Rainey ..... B05B 11/00416 222/321.9
6,321,937 B1 * 11/2001 DeSimone ..... A47K 10/3818 221/45
7,690,535 B2 * 4/2010 Law ..... B05B 11/3067 222/153.13
9,826,813 B2 * 11/2017 Lee ..... B01F 15/0227
9,913,561 B1 * 3/2018 Rodriguez ..... A47K 10/32
2011/0042486 A1 * 2/2011 Luft ..... B05B 11/00 239/303
2011/0256082 A1 * 10/2011 Klingman ..... A61K 8/365 424/65
2012/0152771 A1 * 6/2012 Garside ..... B65D 83/0805 206/223
2017/0050200 A1 * 2/2017 Thompson ..... B05B 11/0086
2018/0065796 A1 * 3/2018 Russett, III ..... B65D 85/20
2018/0070780 A1 * 3/2018 Rodriguez ..... B05B 11/3052

* cited by examiner

*Primary Examiner* — Gene O Crawford
*Assistant Examiner* — Kelvin L Randall, Jr.

(57) ABSTRACT

A portable multicomponent fluid and paper based product dispenser having an airless pump dispensing unit mounted to a container body having an outlet through which disposable goods may be successively drawn. The airless pump housing unit contains a diaphragm mechanism and spring nozzle positioned in the center of the apparatus superiorly and a disk shaped base plate positioned in the bottom inner circumference of the shell, separated by aqueous solvent. Air intake received from the bottom portion of the outer shells of both the upper and lower compartment structures, causes an upward flow of product via a vacuum chamber. A wall which creates division between the upper and lower compartments and the remainder of the outer shell houses the enclosed interfolded sediment free disposable wipes that are removed through an outlet. The outlet is closeable by means of a detachable cap.

12 Claims, 7 Drawing Sheets

PORTABLE MULTI-COMPONENT FLUID AND PAPER BASED PRODUCT DISPENSER

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

Field of invention: This invention relates to dispensers for use in dispensing both flowable and paper based products and to methods of use thereof. The present proposals are particularly concerned with airless pump dispensers' adopted aim for use with flowable products combined with an apparatus configured to contain a dispenser for disposable paper based products. This invention relates to sanitizer dispensers in conjunction with hand wipe dispensers; particularly but not exclusively of the kind for dispensing wipes and sanitizers used in hospitals or medical treatment facilities. This multi dispenser may be used in domestic and or commercial environments.

Airless pumps are known in the art, i.e., U.S. Pat. Nos. 10,464,088 and 7,891,522 and have been developed for a wide range of applications including dispensing personal care products. Airless pumps are utilized for their airtight seal, which eliminates bacteria and other harmful contaminants. Through its airtight seal, serums, creams, and preservative-free formulated creams are protected from excessive exposure to air, thus increasing the product's shelf life.

Paper based product dispensers are utilized for cleaning surfaces and personal hygienic use. A number are well known in the art and are commonly available on a commercial basis such as U.S. Pat. No. 10,300,162. The most common wipe dispensers are known for dispensing interconnected wipes. The dispenser may include a container body and a removable lid forming an interior region into which a plurality of interconnected or folded wipes may be disposed. An exemplary dispenser involves pulling on a lead end of an initial wipe which causes a following additional wipe to also be pulled thereby following the initial wipe. The removable lid may cover at least a portion of the container aperture. A landing member in the lid covers at least a portion of the container aperture by extending from the top rim of the container body toward the middle of the interior region. A gripping channel may be provided through the leading member, through which the lead end of the lead wipe may be threaded.

With current models threading allows for the following wipe to be exposed to contaminants in the air. This invention introduces a dispenser structure for interfolded paper based products that includes a cylindrical container having a supportive surface for supporting a stack of interfolded wipes. The side walls of the container extend in a vertical direction perpendicular to the supportive surface. To prevent the exposure and release of multiple wipes at a time, there will be no interconnection of wipes via the central aperture. The circumference of the aperture will be minimized to that of ⅓ diameter of the folded wipe. This closed system wipe dispenser will contain a tight fitting lid that provides a single, sanitary disposable wipe with every successively dispensed, thereby protecting unused wipes from contaminants and microbials.

BRIEF SUMMARY OF THE INVENTION

According to the present invention, a portable multi component fluid and paper based product dispenser comprises:

A container having first and second compartments, the first compartment being dimensioned to house an aqueous substance.

The second compartment being dimensioned to store a supply of paper goods in use;

The first and second compartments being separated by a base.

The first compartment having an air pump dispenser through which fluid is being dimensioned to house an aqueous substance that is moved upward via a base plate.

The second compartment having an outlet through which wipes may be successively drawn;

The invention relates to the art of a conventional airless pump that is constructed with a wipe dispenser attachment.

BRIEF DESCRIPTION OF THE SEVERAL VIEWS OF THE DRAWING(S)

The present invention may be more fully appreciated with reference to the following detailed description, which in turn refers to the drawings, in which.

DETAILED DESCRIPTION OF THE INVENTION

The multi-component fluid and paper based product dispensers to which the present application is directed are dispensers for various paper based goods and liquids or semi-liquid compositions (generally referred to as "fluids," and thus including a large variety of flowable compositions).

Figure 1:
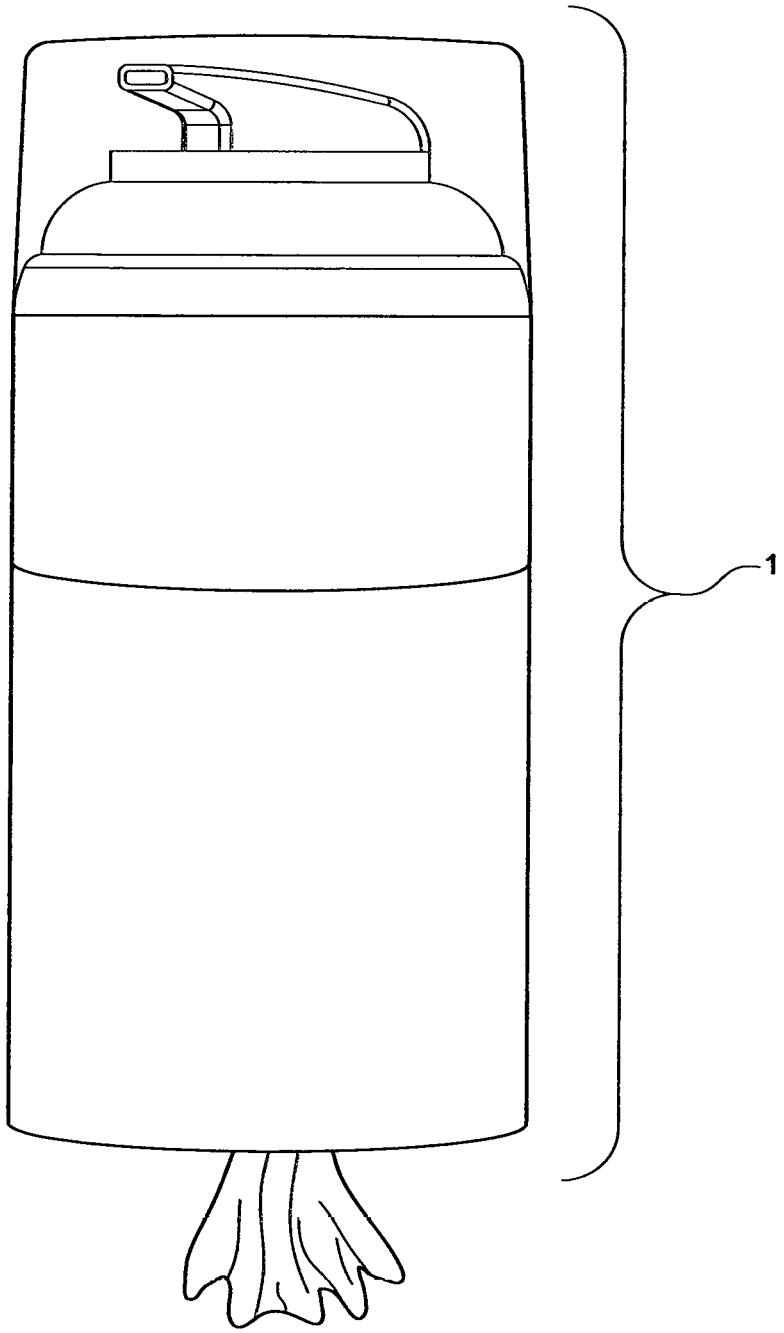
FIG. 1 is a perspective view showing the overall external shape of the dual airless pump and wipe dispenser apparatus.
Figure 2:
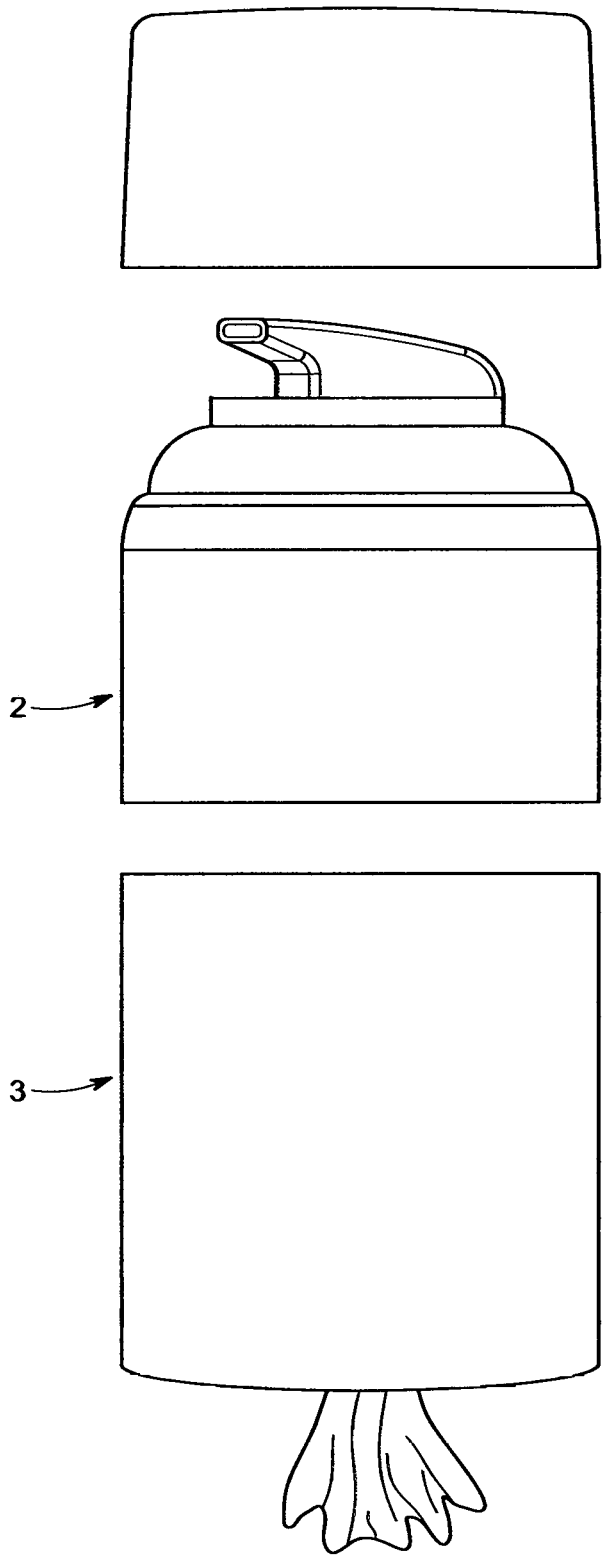
FIG. 2 is a front elevational view of a dual airless pump and wipe dispenser in accordance with the present invention shown in FIG. 1.
Figure 3:
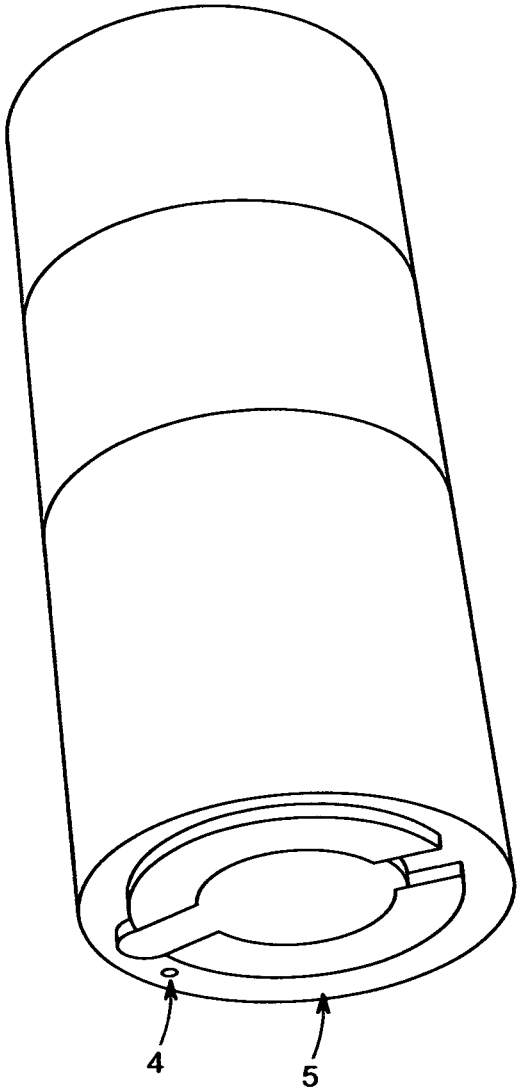
FIG. 3 is a side, posterior view of the dual airless pump and wipe dispenser of the present invention displaying the wipe dispenser attachment.

Turning to the Figures, in which like reference numerals refer to like elements thereof, this invention as shown in FIG. 1 details a cylindrical shell 1 made of rigid material, such as polypropylene configured as dual container bodies in FIG. 2 with an airless pump 2 mounted in an upper portion of the housing with a bottom compartment 3 having an outlet through which disposable paper goods may be successively drawn.

Figure 4:
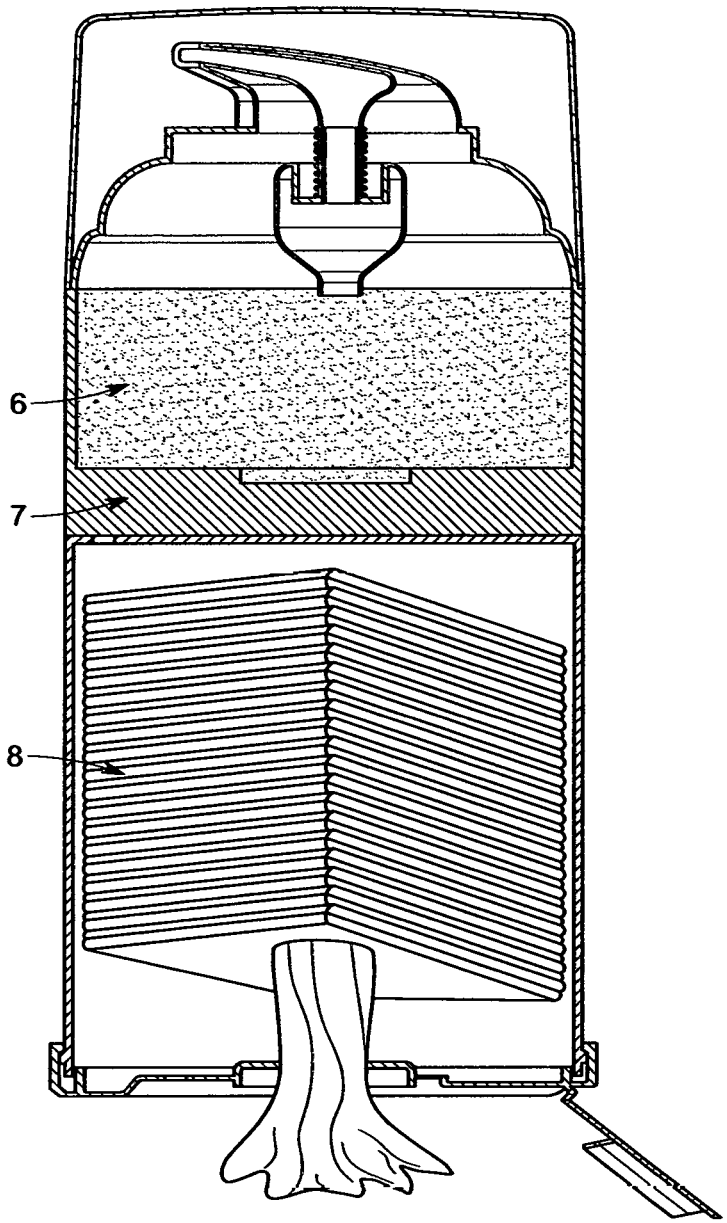
FIG. 4 is a side, cross sectional, exploded view of portions of the dual airless pump and wipe dispenser of the present invention.
Figure 5:
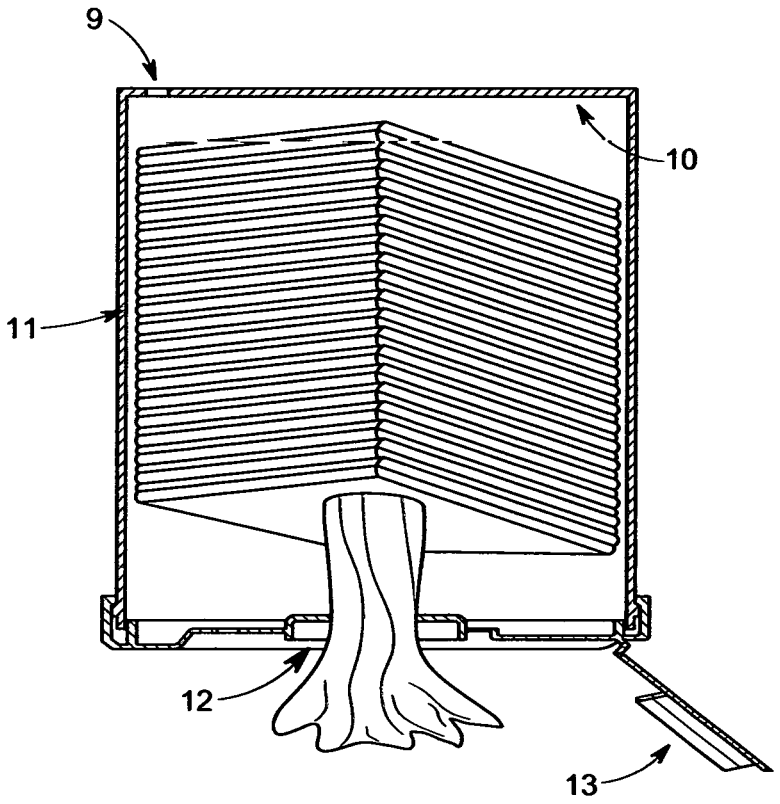
FIG. 5 is a partial, cross sectional perspective view of portions of the wipe dispenser of the present invention shown in FIG. 4.
Figure 6:
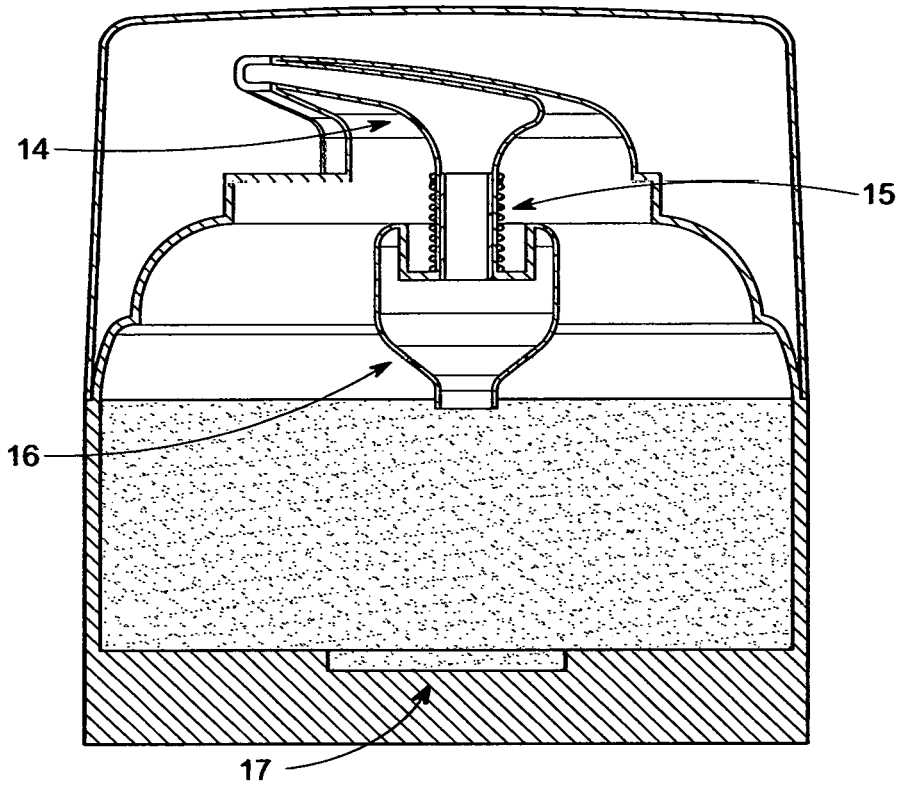
FIG. 6 is a partial cross sectional perspective view of portions of the airless pump dispenser of the present invention shown in FIG. 4.
Figure 7:
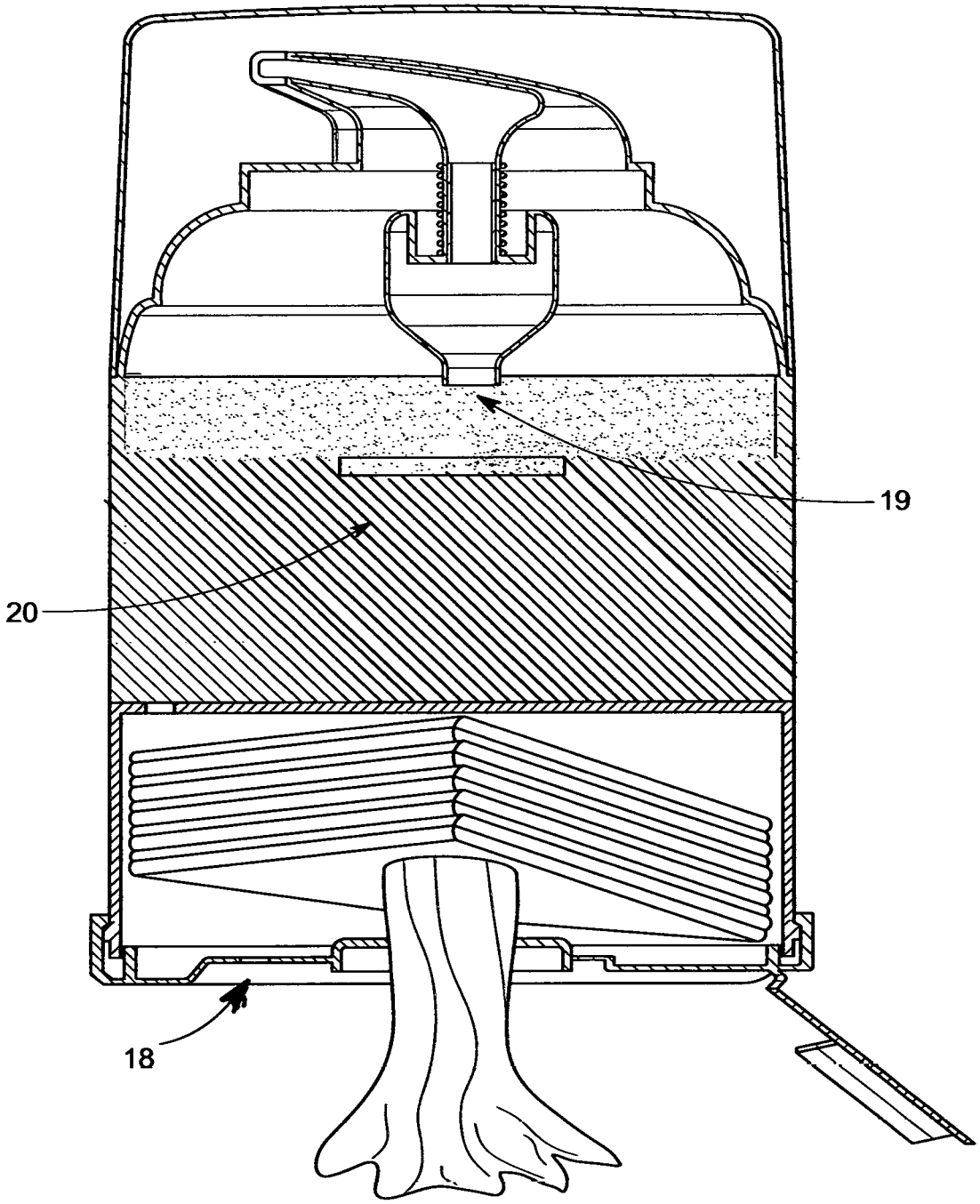
FIG. 7 is a view showing the overall operational state and actual shape of the dual dispenser apparatus according to the present invention.

The first compartment as shown in FIG. 4, being dimensioned to store aqueous solvent 6. Turning to FIG. 6 the airless pump contains a diaphragm mechanism 16 and spring nozzle 15 disposed in the center of the apparatus that extends toward the interior of the structure to create a vacuum effect, pulling air out and bringing the aqueous solvent with it to be released via the pump actuator 14. The diagram comprises an inlet 19 shown on FIG. 7 that is responsible for fluid connection to the housing unit of the upper airless pump.

Positioned beneath the aqueous solvent sits a disk shaped base plate 17 which is fastened into the inner circumference of the shell. The base plate causes an upward flow of product via a vacuum chamber.

Air intake is received from the bottom of the base plate within the base end. A small intake hole 9 positioned on the bottom housing structure's upper wall, allows air 7 to enter and fill the space underneath the disk plate. This forms a steady flow of pressure and moves the disk upwards 20 to dispense the product.

Directly below the base plate is a wall 10 which creates division between the upper and lower compartments. The remainder of the outer shell 11 houses the enclosed interfolded sediment free wipes 8 that are removed through an outlet 12. The outlet may be closeable by means of a detachable cap 13, 5.

A second intake (air) hole 4,18 placed in the bottom of the outer shell enhances the operation of the push base plate.

All structures are closely fastened to the upper compartment of the shell within the space of the air pump head to ensure a secure vacuum state.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

SEQUENCE LISTING

"Not Applicable"

What is claimed is:

1. A portable multi-component fluid and paper based product dispenser, said multi-component fluid and paper based product dispenser comprising:

a cylindrical container having first and second compartments;

said container having first and second compartments containing an upper airless pump compartment housing unit and a lower paper based product dispenser unit structure compartment;

said upper airless pump compartment having a top end and a base end;

said lower paper based product dispenser unit compartment having dimensioned structure to store a supply of paper based products;

said dimensioned structure of said lower paper based product dispenser unit compartment having a top end and a base end;

said top end of said upper airless pump compartment having a diaphragm mechanism and spring nozzle;

said base end of said upper airless pump compartment having a base plate;

said top end and said base end of said upper airless pump compartment are separated by aqueous solvent;

said top end of said lower paper based product dispenser unit having outer shell upper wall;

said outer shell upper wall of said top end of lower paper based product dispenser creates division between said upper airless pump compartment and said lower paper based product dispenser unit compartment;

said outer shell upper wall of said top end of said lower paper based product dispenser unit compartment having an intake hole;

said base end of said lower paper based product dispenser unit having an outlet and intake hole;

said outlet of said base end of said lower paper based product dispenser unit is closeable by means of a detachable cap.

2. The upper airless pump of claim 1, wherein said spring member comprises a helically coiled spring nozzle.

3. The upper airless pump of claim 2, wherein said spring member is affixed to said diaphragm.

4. The upper airless pump of claim 3, wherein said diaphragm comprises an inlet for fluid connection to said upper airless pump housing unit compartment.

5. The diaphragm of claim 4, wherein said diaphragm extends towards the interior of said upper air less pump structure to create a vacuum effect.

6. The upper airless pump of claim 1, wherein said base plate positioned in the inner circumference of a design apparatus to force solvent upward into the said diaphragm of the said upper airless pump compartment.

7. The intake hole of said outer shell upper wall of said top end of said lower paper based product dispenser in claim 1, wherein said intake hole allows the flow of air into the apparatus which in turn raises a disc plate.

8. The fluid dispenser of said multi-component fluid and paper based product dispenser of claim 1 is capable of dispensing hand sanitizer.

9. The paper based products dimensioned in the structure of claim 1, wherein said paper based products are interfolded.

10. The paper based products of claim 9, wherein said paper based products are non threaded, sediment free wipes.

11. The paper based products of claim 10, wherein said paper based products are hand towelettes.

12. The paper based products of claim 11, wherein said hand towelettes are face towelettes.

* * * * *